US006079563A

United States Patent [19]

Katchmazenski

[11] Patent Number: 6,079,563

[45] **Date of Patent: *Jun. 27, 2000**

[54] CONTAINER FOR COMPRESSORS AND OTHER GOODS

[76] Inventor: Robert A. Katchmazenski, c/o Liberty Carton Company, Texas, 5100 Glenview Dr., P.O. Box 14989, Fort Worth, Tex. 76117

[ * ] Notice: This patent issued on a continued prosecution application filed under 37 CFR 1.53(d), and is subject to the twenty year patent term provisions of 35 U.S.C. 154(a)(2).

[21] Appl. No.: 09/291,818

[22] Filed: Apr. 14, 1999

Related U.S. Application Data

[60] Provisional application No. 60/081,719, Apr. 14, 1998, and provisional application No. 60/081,720, Apr. 14, 1998.

[51] Int. Cl.[7] ..... B65D 81/02

[52] U.S. Cl. ..... 206/583; 206/592; 206/485; 206/784; 229/173

[58] Field of Search ..... 206/592, 784, 206/583, 418, 419, 485; 229/148, 178, 168, 173, 319

[56] References Cited

U.S. PATENT DOCUMENTS

| | | | |
|---|---|---|---|
| 2,333,715 | 11/1943 | Hahnemann | 206/562 |
| 2,620,962 | 12/1952 | Powell . | |
| 2,700,456 | 1/1955 | Gillam | 206/485 |
| 2,714,981 | 8/1955 | Leavens | 206/583 |
| 2,724,495 | 11/1955 | Wasyluka . | |
| 2,808,191 | 10/1957 | Cramer | 206/562 |
| 2,856,067 | 10/1958 | Sparks . | |
| 2,870,949 | 1/1959 | Currivan | 206/583 |
| 2,903,174 | 9/1959 | Frankenstein . | |
| 3,009,622 | 11/1961 | Leone | 206/485 |
| 3,029,998 | 4/1962 | Taylor, Jr. | 206/583 |
| 3,059,830 | 10/1962 | Kramer | 206/583 |
| 3,093,240 | 6/1963 | Donahue et al. . | |
| 3,093,290 | 6/1963 | Banks et al. . | |
| 3,108,731 | 10/1963 | Royce . | |
| 3,181,766 | 5/1965 | Kane et al. . | |
| 3,225,509 | 12/1965 | May . | |
| 3,325,079 | 6/1967 | Puckett . | |
| 3,437,198 | 4/1969 | Van Saun et al. . | |
| 3,637,130 | 1/1972 | Farquhar | 206/562 |
| 3,669,336 | 6/1972 | Robinson . | |
| 3,669,337 | 6/1972 | Struble | 206/583 |
| 3,768,639 | 10/1973 | Dogliotti . | |
| 3,823,864 | 7/1974 | Ohkubo . | |
| 3,942,710 | 3/1976 | Collie . | |
| 4,280,622 | 7/1981 | Nelson, Jr. . | |
| 4,682,693 | 7/1987 | Moffit et al. . | |
| 4,832,199 | 5/1989 | Rigby | 206/485 |
| 4,889,239 | 12/1989 | Sandish et al. | 206/562 |
| 5,213,215 | 5/1993 | Prevot . | |
| 5,287,968 | 2/1994 | Ridgeway | 206/583 |
| 5,301,871 | 4/1994 | Gross et al. | 206/562 |
| 5,462,171 | 10/1995 | Moog et al. . | |
| 5,522,504 | 6/1996 | Levi . | |
| 5,577,606 | 11/1996 | Schwentuchowski et al. | 206/485 |
| 5,678,968 | 10/1997 | Bourgeois et al. . | |
| 5,685,431 | 11/1997 | Chambers et al. . | |
| 5,695,052 | 12/1997 | Damato | 206/562 |
| 5,818,519 | 10/1998 | Wren . | |
| 5,915,556 | 6/1999 | Simpson | 206/461 |

*Primary Examiner*—Paul T. Sewell
*Assistant Examiner*—Nhuan T. Lam
*Attorney, Agent, or Firm*—Patterson & Keough, P.A.

[57] ABSTRACT

A container, for storing products such as automobile compressors, made from a single piece of material, preferably corrugated fiber, and assembled by folding along score lines and secured by engaging tongue and matching groove members to form a top, a bottom and sidewall members of the container. Internal product support structures are formed, from the original piece of corrugated fiber, by folding along additional score lines.

9 Claims, 17 Drawing Sheets

23
17
25
155
153
125
126
106
163
164
166
167
226
210
216
228
207
209
212
201
239
208
183
172
195
187
181
174
73
173
176
175
121
141
124
108
168
169
214
117
151
161
101
12
131
103
115
157
97
221
91
223
205
236
206
233
231
241
249
243
193
203
246
185
85
191
171
93
95
55
83
66
64
61
68
250
81
51
63
53
57
45
36
43
41
47
71
75
177
178
76
74
77
73
78
79
39
35
37
40
38
33
21
31
23

77
79
71
176
40
171
31
81
191
51
161
101
151
111
106
126
150
117
125
139
137
146
119
115
112
113
105
121
141
117
123
133
124
152
145
136
131
142
144
143

CONTAINER FOR COMPRESSORS AND OTHER GOODS

CROSS-REFERENCE TO RELATED APPLICATION

The subject matter of this application is related to the subject matter of commonly assigned U.S. Provisional Application Serial No. 60/081,719, filed Apr. 14 1998, and U.S. Provisional Application Serial No. 60/081,720, filed Apr. 14, 1998, which are incorporated herein by reference and priority to which is claimed under 35 U.S.C. § 119(e).

BACKGROUND OF THE INVENTION

1. Field of the Invention

The invention relates to containers for storing compressors and other goods.

2. Description of Related Art

In the container or box art, it is well-known to use packing materials such as foam structures, plastic blister sheets and fiber tubing to be placed by hand or by other means around products to secure them within containers. It is also known in the box art to assemble a cardboard box using adhesives, staples, or other means to ensure a container retains its shape while in use. Further, it is known to use separately constructed internal support structures to accommodate and secure goods within boxes.

In the past, compressors and other cylindrical goods were stored in boxes similar to the box depicted in FIG. 1. The box in FIG. 1 was assembled by folding along score lines and engaging the tabs into the tab slots. Support for the compressor, once placed inside the box, was provided by packing material. Packing material, such as fiber tubing, wadded paper, or specially constructed support structures, was placed around or on the compressor to secure it in place. Further, R4 compressors, which have pulley or clutch assemblies attached to the compressor shafts, were typically stored with the compressor resting on the end of the shaft, that is, with the shaft in a vertical position within the box. This configuration was prone to cause damage to the compressor if the box were to be dropped or otherwise mishandled.

Other storage boxes that are known in the relevant art include U.S. Pat. No. 2,903,174 (the '174 patent) to W. P. Frankenstein. The '174 patent discloses a blank that is cut and scored to aid assembly, and uses tuck flaps and adhesive to secure the form of the container. A combination of integrated and non-integrated support pieces were then used to provide additional support for the goods stored therein.

Another related prior art storage container is the shock-absorbing package disclosed in U.S. Pat. No. 5,462,171. This patent discloses two separate paper honeycomb pads that are used to secure a cylindrical object within a standard box. These support structures are separately constructed. The honeycomb pads are rectangular in shape to fit snugly against the walls of the box, with an opening defined in the center of one of the honeycomb pads to accept and support a cylindrical object.

Yet another packaging invention is disclosed in U.S. Pat. No. 5,685,431. Here again, specially constructed and assembled packaging inserts are used. These inserts are uniquely designed to support components of a clutch set. The supports are not integrated with the overall package and are assembled separately from the exterior package. The product support structures are not readily adaptable to various configurations of goods.

The use of non-integrated specific support structures adds time and expense to the packaging process by requiring the separate manufacture and assembly of the non-integrated supports. Similarly, a corrugated fiber storage container constructed by gluing flaps to form the top, sides and bottom, is costly, time consuming to assemble, and the adhesive material may not be environmentally suitable. Further, the creation of specific support structures to match a specific article adds time and expense to the packaging process, and can also require additional adhesives or materials that add undesirable time and expense to the storage process.

There is a need for a container for storing compressors and like-shaped cylindrical goods that can be erected from a single blank of corrugated cardboard, that can be assembled without adhesives, staples, or other means that require additional material and time, and that incorporate integrated support structures that can accommodate a variety of compressors and like-shaped goods.

SUMMARY OF THE INVENTION

A packaging container is provided which requires no inner packing materials or separately constructed product support structures, requires no adhesive or staples to hold the container together, is made from a single piece of material, and allows the storage of, in one embodiment, an R4 compressor with the shaft in a horizontal position.

The invention is designed from a single blank of material, preferably corrugated fiber, that is cut in a pre-determined shape and is scored with folding lines to form sub-sections. The blank of corrugated fiber is also cut with tabs and matching tab slots, so that when all tabs are properly engaged with tab slots, the top, bottom and sidewalls of the invention are formed and secured, eliminating the need for adhesives or staples to secure the container structure.

Once the container is folded as described below, and the tab and tab slots are engaged, a portion of corrugated fiber can be folded, in one embodiment, into a V-shaped support structure so that a cylindrical-shaped compressor can be supported on its side. This V-shaped support structure is part of the original piece of corrugated fiber. The V-shape of the support structure allows the secure storage of different sized and shaped compressors, and like devices, using only one general type of support structure.

A top support structure is also formed from the original piece of corrugated fiber. In one embodiment, the top support structure is designed to engage the interior top and front of the container on one side and support the article with an opposing edge.

BRIEF DESCRIPTION OF THE DRAWINGS

Embodiments of the invention will be described with reference to the Figures, in which like reference numerals denote like elements and in which.

DETAILED DESCRIPTION OF THE PREFERRED EMBODIMENTS

This application describes and illustrates a storage container for automobile compressors and the like, that will accommodate various automobile compressors and attached clutch mechanisms or pulleys. The invention, however, is not necessarily limited to storage of automobile compressors and attached components. On the contrary, embodiments of the invention have applications to a wide variety of article storage needs. Therefore, while the invention will be described with respect to automobile compressors and the like, the invention is not necessarily limited to these uses. Further, this application describes a preferred material for the container herein to be corrugated fiber; however, corrugated plastic, solid fiber, and other materials known to those skilled in the art could be used advantageously to practice the invention.

Figure 3:
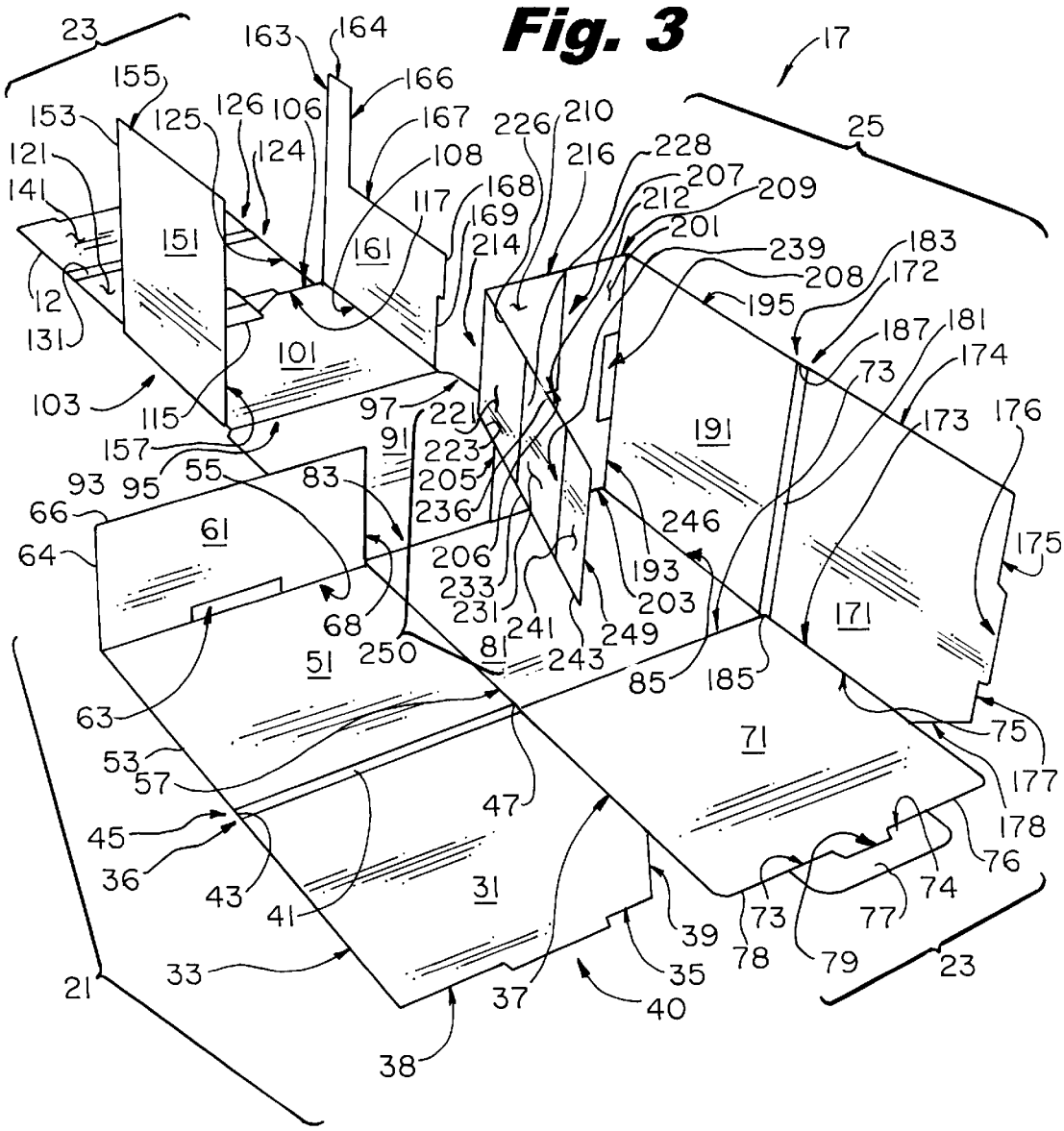
FIG. 3 is a perspective view of the box depicted in FIG. 2, partially assembled.

Referring to FIG. 3, a blank 17 for a container in accordance with a first embodiment of the invention is depicted. The general sequence of assembly is depicted in FIGS. 3 through 8.

The blank 17 is preferably a unitary piece of corrugated fiber. The blank 17 includes a plurality of edges, cut-outs and score lines. Blank 17 includes left section 21, center section 23, and right section 25. Left section 21 includes sub-sections 31, 41, 51, and 61. Sub-section 31 includes edge 33, score line 36, edge 37, tapered edge 39, edges 35 and 38, and tab 40. Sub-section 31 joins sub-section 41 at score line 36. Sub-section 41 includes score line 36, edge 43, score line 45, and edge 47. Sub-section 41 is interposed between sub-sections 31 and 51. Sub-section 51 includes score line 45, edge 53, score lines 53, 55, and 57. Sub-section 51 joins sub-section 61 at score line 55. Sub-section 61 includes edges 64, 66, and 68, and score line 55. Tab slot 63, which is a cut-out configured to accept tab 40, includes sub-section 61 and score line 55.

Middle section 23 of blank 17 generally includes tab 77 and sub-sections 71, 81, 91, 101, 111, 121, 131, 141, 151, and 161. Sub-section 71 includes edge 72, score line 73, edges 75 and 76, tab 79, and edge 78. Sub-section 71 joins sub-section 81 by score line 73. Sub-section 81 includes score lines 57, 83, 85, and 73. Sub-section 81 joins score line 91 at score line 83. Sub-section 91 includes edge 93, score line 95, edge 97, and score line 83. Sub-section 91 joins sub-section 101 at score line 95. Sub-section 101 is further defined by score lines 103, 105, 106, and 108.

Locking tongue 111 lies between sub-sections 101 and 121. Locking tongue 111 joins sub-section 101 at score line 115, and is otherwise freestanding. Locking tongue 111 consists of two sub-sections—sub-sections 119 and 112. Sub-sections 119 and 112 are separated by score line 113. Score line 113 lies on an extension of score lines 106 and 105. Cut-out portion 117, which lies proximate to locking tongue 111, lies generally on the extension of score lines 106 and 105, and is configured to accept tab 77. Sub-section 121 includes edge 123, score line 124, oval cut-out 150, score line 125, and edge 126. Sub-section 131 lies between sub-sections 121 and 141. Sub-section 131 includes score line 124, edge 133, score line 136, oval cut-out 150, score line 137, and edge 139. The last sub-section of section 23 to be described is sub-section 141. Sub-section 141 includes edges 142 and 143, recessed edge 144, edges 145 and 146, score line 137, oval cut-out 150, and score line 136. Sub-sections 121, 131, and 141 form generally the upper support structure 152.

Right section 25 is composed generally of sub-sections 171, 181, 191, 201, 210, 221, 231, and 241. Sub-section 171 includes edge 173, score line 172, edges 174 and 175, tab 176, edge 177, and tapered edge 178. Sub-section 171 adjoins sub-section 181 along score line 172. Sub-section 181 includes score line 172, edge 185, score line 183, and edge 187. Sub-section 181 lies between sub-sections 171 and 191. Sub-section 191 includes score lines 85 and 193, edge 195, and score line 183. Sub-section 191 adjoins sub-section 201 along score line 193. Sub-section 201 includes edge 209, score line 193, edges 203, 205, and 206, and score line 207. Tab slot 208 includes sub-section 201 and score line 193, and is configured to accept tab 176. Sub-section 210 joins sub-section 201 along score line 207. Sub-section 210 includes score line 214, edge 216, score line 207, and edge 212. Sub-section 210 is connected to sub-section 221 by score line 214. Sub-section 221 is further defined by edge 26, score line 228, and edge 223. Sub-section 231 joins sub-section 221 at score line 228. Sub-section 231 includes score line 228, edges 235, 236 and 239. Sub-section 241 appends to sub-section 231 at score line 239. Sub-section 241 includes score line 239, edges 246, 249, and 243. Sub-sections 241, 231, 221, and 210 are combined to form lower product support structure 250.

Assembly and use of the embodiment of the invention shown in FIGS. 2 through 10 will now be described, commencing with blank 17 in a substantially flat configuration on a generally horizontal surface. Sub-section 61 is folded along score line 55, such that sub-section 61 is substantially perpendicular to sub-section 51. Likewise, sub-section 201 is folded along score line 193, so sub-section 201 is substantially perpendicular to sub-section 191. Next, section 25 is folded along score line 85, such that sub-section 171 is generally perpendicular to sub-section 71, and sub-section 191 is generally perpendicular to sub-section 81, such that edge 203 of sub-section 201 lies generally along score line 83. Sub-sections 241, 231 and 221 are angled over sub-section 81 at score line 214. Sub-section 151 is then folded along score line 103 until it becomes generally perpendicular with sub-section 101. Likewise, sub-section 161 is folded along score line 108 until it becomes generally perpendicular with sub-section 101. This stage of the assembly of the invention is depicted in FIG. 3.

Figure 4:
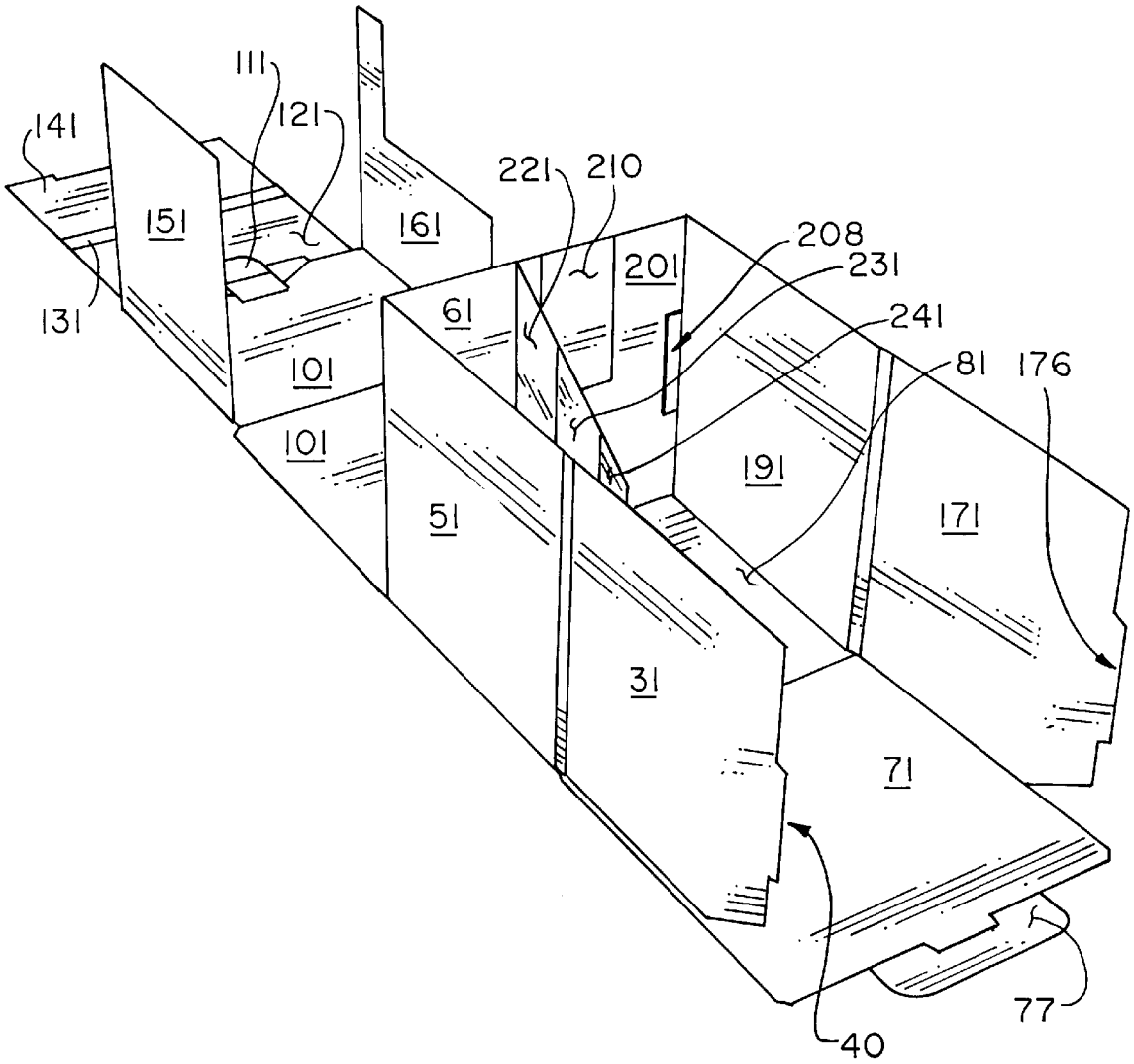
FIG. 4 is similar to FIG. 3, but with the box in a further stage of assembly.

Section 21 is then folded along score line 51 such that edge 66 of sub-section 61 comes into contact with edge 205 of sub-section 201. This stage of the assembly of the invention is generally shown in FIG. 4.

Figure 5:
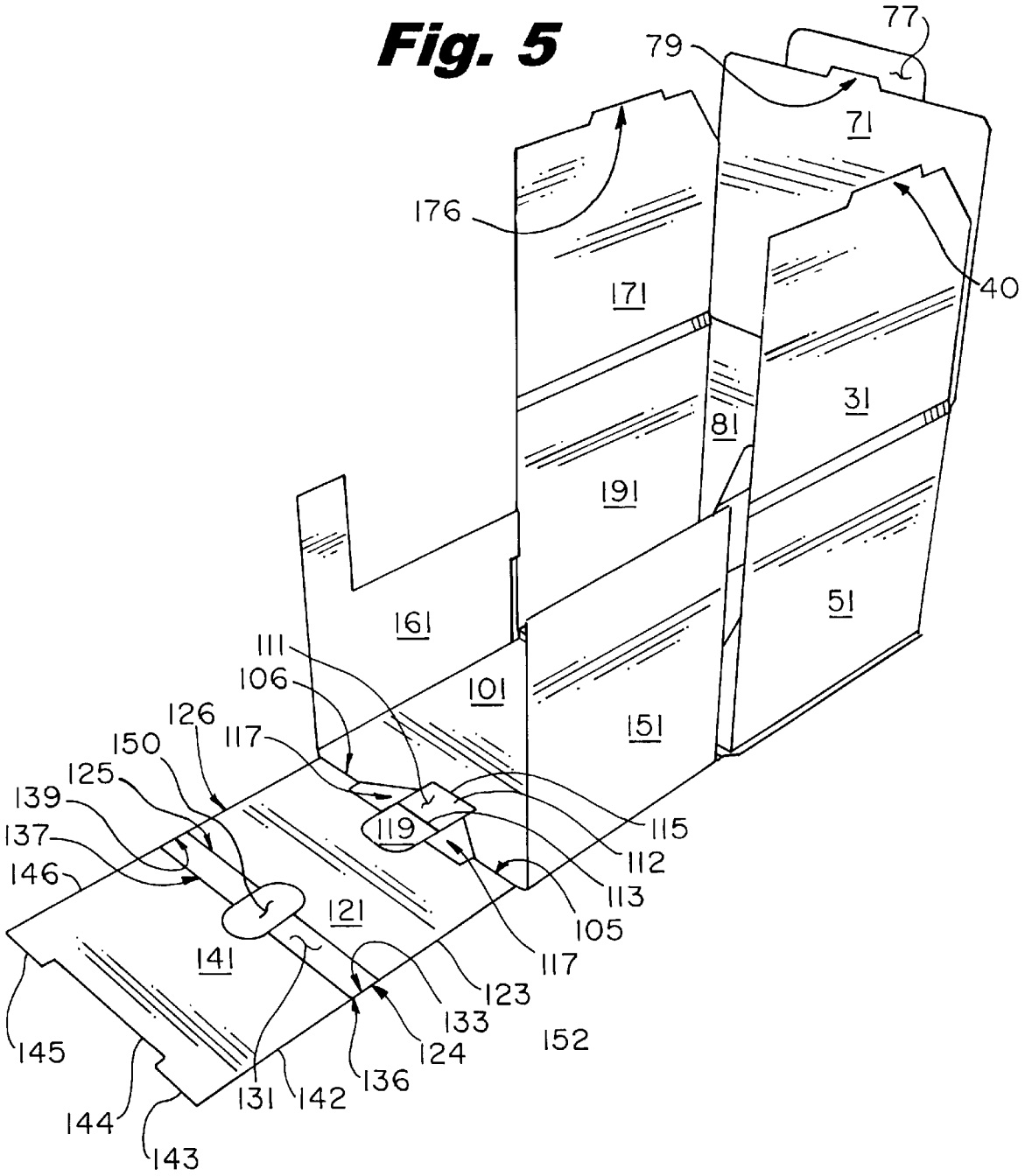
FIG. 5 is similar to FIG. 4, but with the box in a yet further stage of assembly, with the bottom surface partially formed.

Next, sections 21 and 25, and sub-sections 81 and 71 of center section 23 are folded as a unit along score line 83, such that the sub-section formed by sub-sections 61 and 206 now overlays sub-section 91. This stage of the assembly is generally shown in FIG. 5.

Figure 6:
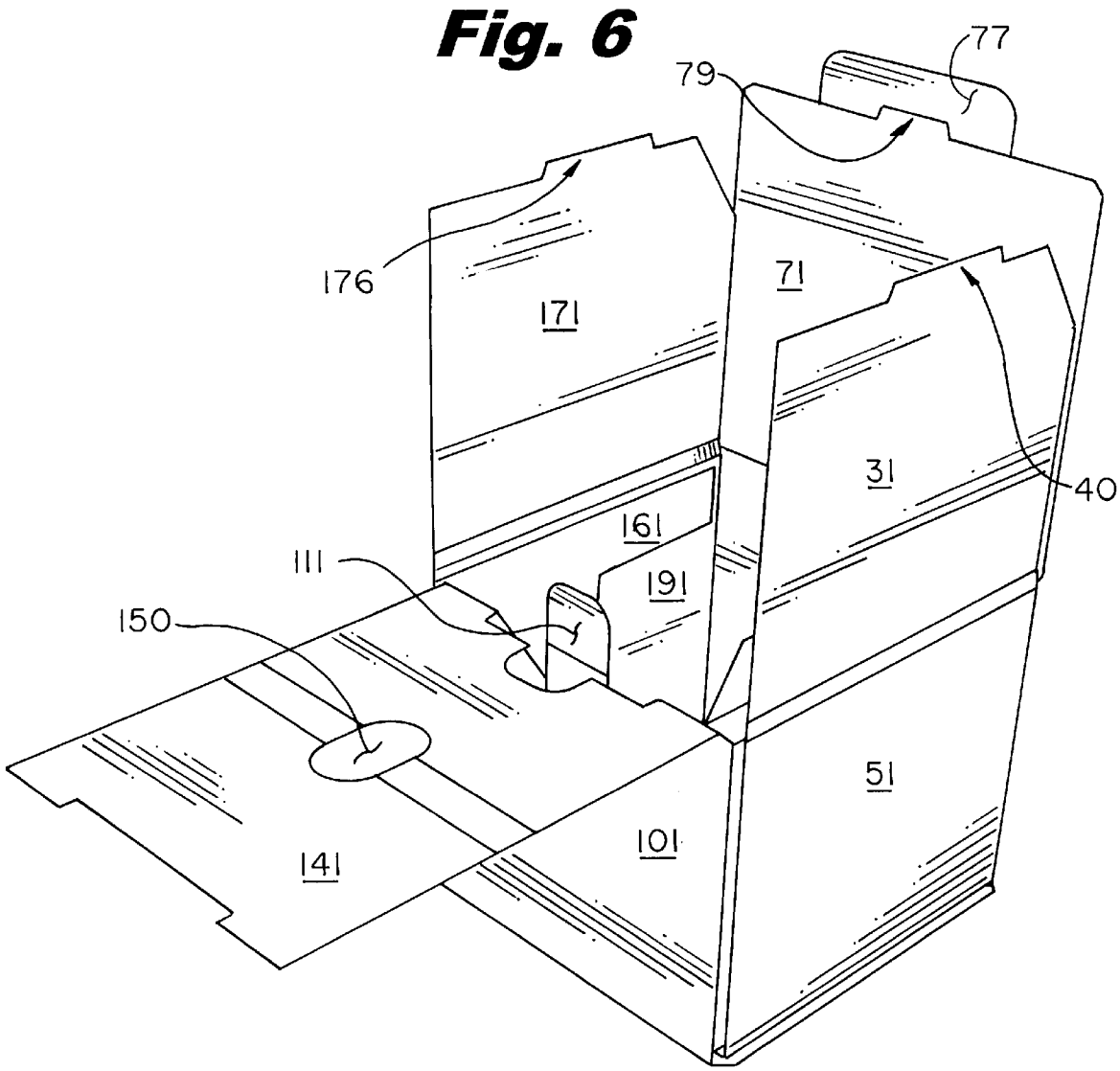
FIG. 6 is similar to FIG. 5, but with the front partially formed.

As can be appreciated from FIG. 6, the next step is to fold sub-section 101 along score line 95 such that sub-sections 151 and 161 slide to the interior of sub-sections 51 and 191 respectively, and such that sub-section 101 is generally perpendicular with the combination of sub-sections 61 and 201. At this stage of the assembly of the container, support structure 152 is folded along score lines 105 and 106 so that the structure is generally perpendicular to front sub-section 101. This stage of the assembly process is generally shown in FIG. 6.

Figure 7:
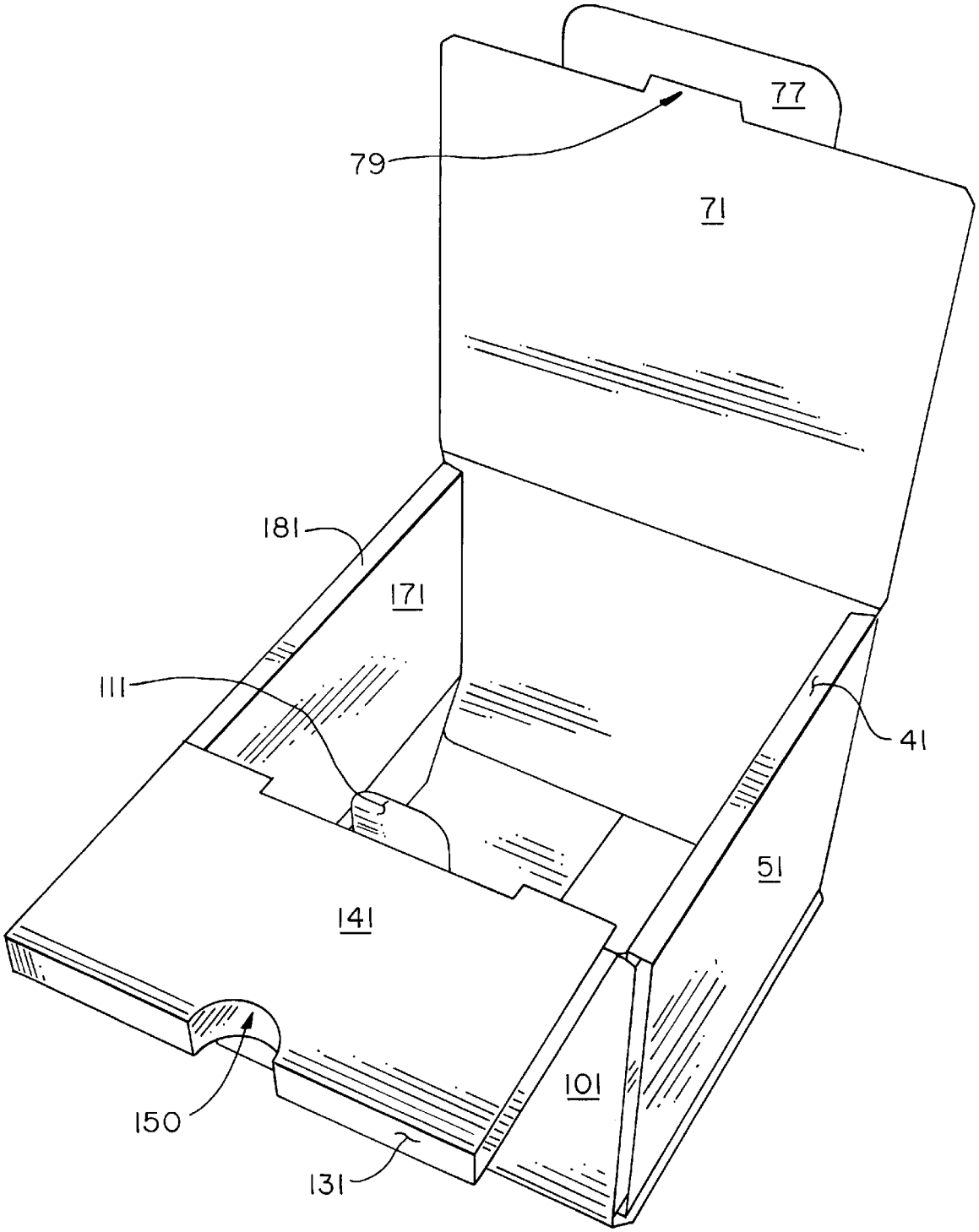
FIG. 7 is similar to FIG. 6, but with the top product support structure partially formed, and side wall flaps in place.
Figure 8:
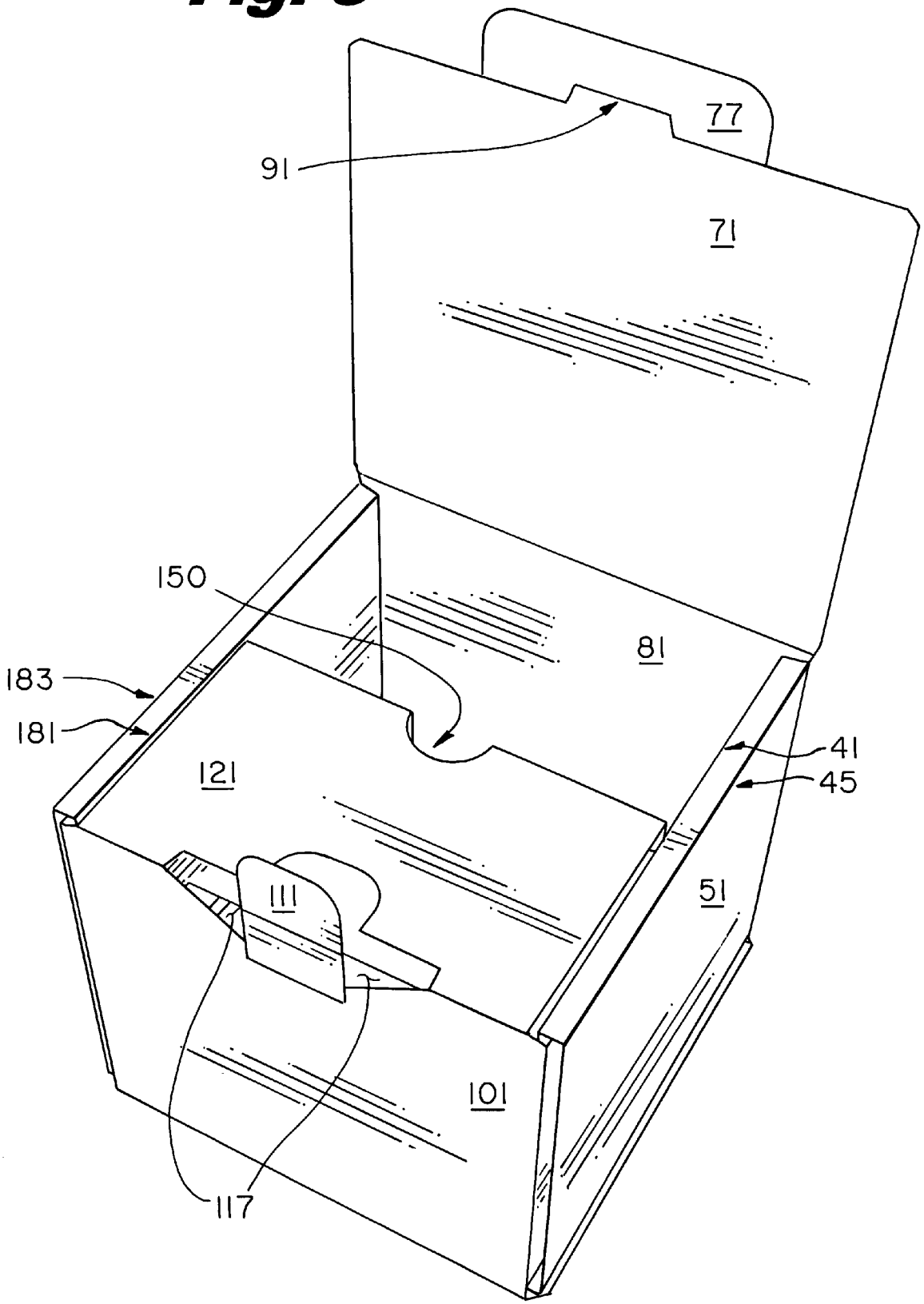
FIG. 8 is similar to FIG. 7, but with the top product support inside the container.
Figure 9:
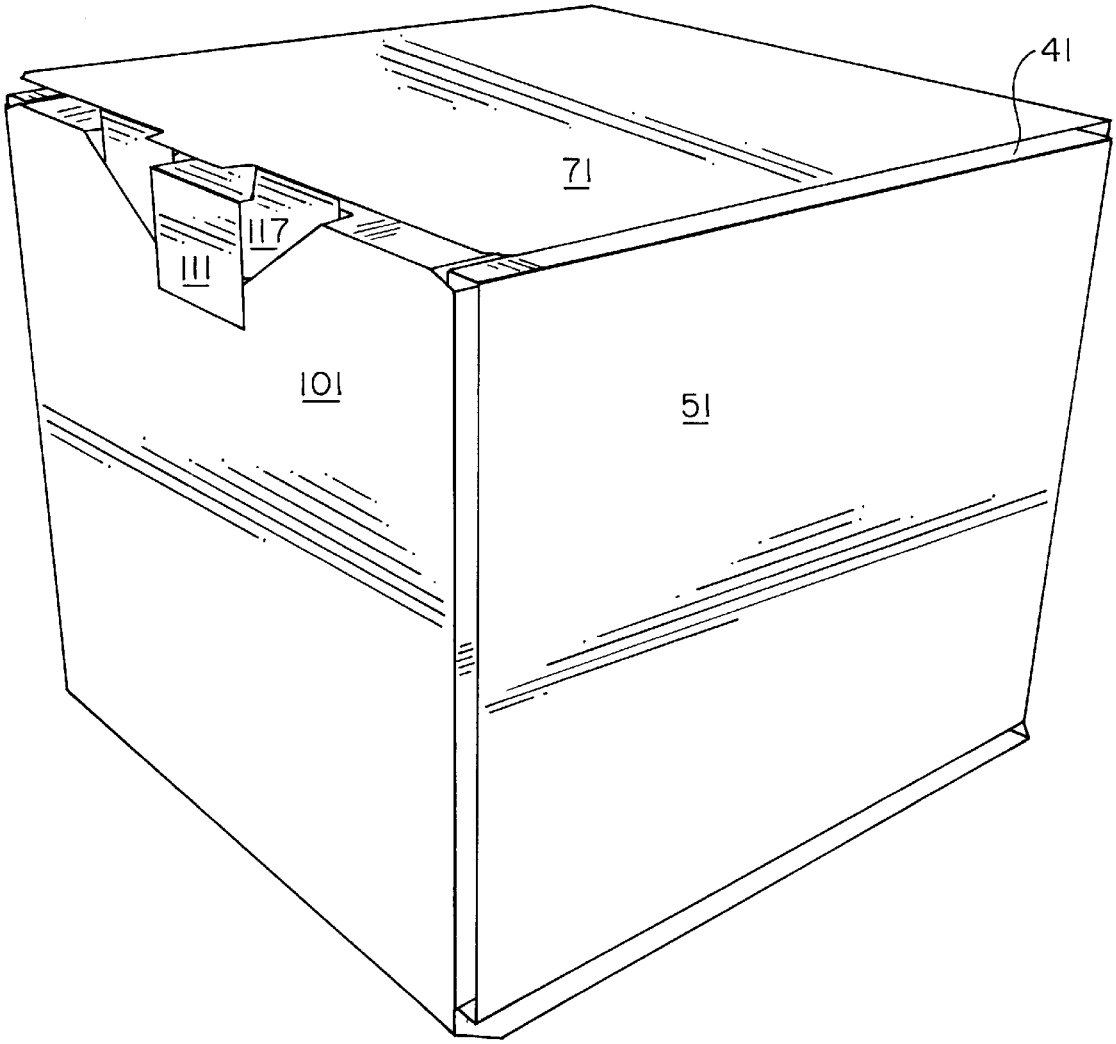
FIG. 9 is similar to FIG. 2, but with no depiction of phantom lines.

Next the product support structure is assembled by folding upper support structure 152 at score lines 136 and 137, as well as score lines 124 and 125. When properly folded, sub-section 144 is generally parallel with sub-section 121, separated generally by a distance equal to the width of sub-section 131. Sub-section 131, at this stage of the assembly, is generally parallel to sub-section 101. Locking tongue 111 is now free-standing, joining sub-section 101 only at score line 115. Sub-section 31 is now folded along score lines 45 and 36 such that tab 40 is frictionally engaged within tab slot 63. Likewise, sub-section 171 is folded along score lines 183 and 182, such that tab 176 is frictionally fit into tab slot 208. It can be appreciated at this stage of the assembly that sub-section 151 now lies between sub-sections 51 and 31, with sub-section 41 forming a generally flat ridge over the top of edge 153 of sub-section 141. Likewise, sub-section 161 now lies between sub-sections 171 and 191, with sub-section 181 forming a ridge over the top of edge 163 of sub-section 161. At this stage of the assembly, lower support structure 250 can also be folded in place. This is accomplished by folding lower support structure along score lines 239, 228, 214, and 207 such that the support forms a generally M-shaped structure, as can be viewed in FIG. 2. Edge 249 and score line 228 contact the bottom of the container formed by sub-sections 91, 61, and 201 to provide support for the product to be stored therein. This stage of the assembly is depicted in FIG. 7.

Next, upper product support 152 is rotated in toward the center of the container along score lines 105 and 106, such that sub-section 142 is generally co-planar with sub-sections 41 and 181. This stage of the assembly is depicted in FIG. 7.

The lid, sub-section 71, is closed by rotating along score line 73 and folding tab 77 along score lines 73 and 74, such that tab 77 is generally perpendicular to sub-section 71 so that it can be frictionally fit into tab slot 117. The rotating of tab 77 along score lines 73 and 74 produces locking slot 79 configured to accept sub-section 119 of locking tongue 111. After tab 77 is frictionally fit within slot 117, locking tongue 111 is folded along score line 113, such that sub-section 119 is approximately perpendicular to sub-section 112 of locking tongue 111. Sub-section 119 of locking tongue 111 is frictionally fit into slot 79. This stage of the assembly can be appreciated from FIG. 9.

The product is placed inside the container simply by lifting the lid of the container, sub-section 71, and pivoting product support 152 away from the interior of the container along score lines 105 and 106. A product, such as an R4 compressor, can then be placed securely into the interior of the container.

The bottom of the container is advantageously formed by two layers of material consisting of sub-sections 91 overlaid by the combination of sub-sections 61 and 201. This double layer adds additional support for the products housed within the container. The sidewalls of the container consist of generally three layers of material, preferably corrugated fiber, being comprised of sub-sections 31, 51, and 151 on one sidewall, and sub-sections 171, 161, and 191 on the other sidewall. This provides extra stability and security for the product in the container in case of lateral shifting. The sidewalls, and front and back walls, of the container are held securely by the overlapping and locking features of the invention.

The primary locking feature of the invention is accomplished by tab 40 locking into slot 63, and tab 176 locking into slot 208. This advantageous design eliminates the need for adhesives, staples, or other additional means of securing the general shape, structure and stability of the storage container. Additionally, the lid of the container has two means of being secured in the closed position. The first is accomplished by tab 176 being securely, frictionally fit into slot 117, and the second is by locking tongue 111 being frictionally fit into locking tongue slot 35. The lid, thus securely closed, also provides additional support to upper product support 152 in the event the product stored in the container applies upward force against top internal product support structure 152.

Figure 1:
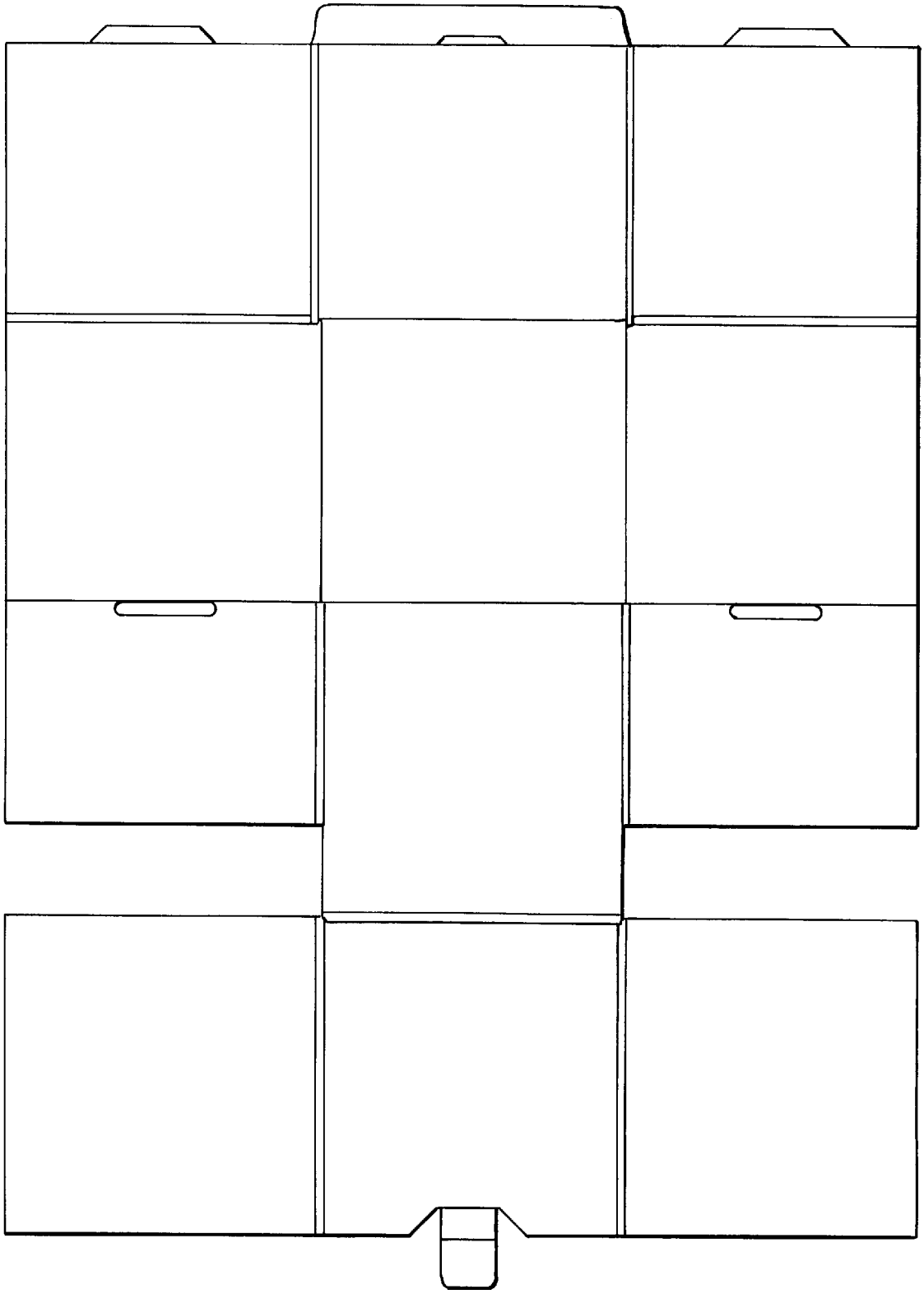
Fig. 1 PRIOR ART
FIG. 1 depicts a conventional compressor storage box.
Figure 2:
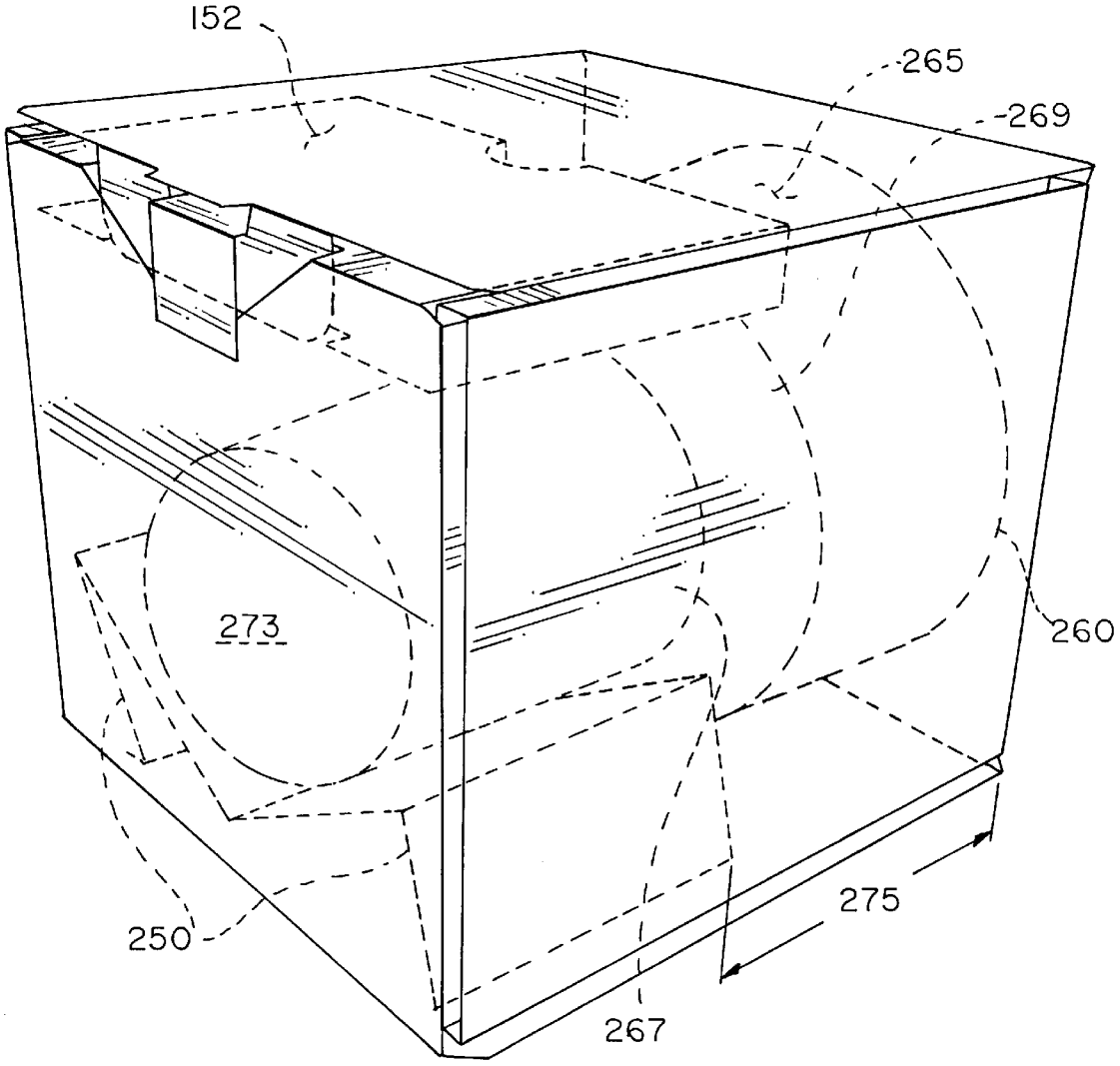
FIG. 2 is a perspective view of a container for compressors and other goods in accordance with the invention, with phantom lines depicting internal supports and product carried within the box.

As can be appreciated from the alignment of the product as depicted in FIG. 2, the container is advantageously designed to accommodate the two different diameters of an R4 compressor. As is depicted in FIG. 2, R4 compressor 265 generally consists of two diameters—the first and the larger diameter 260, and the smaller, second diameter 267. Area 269 represents a step down portion between second diameter 267 and first diameter 260 of compressor 265. The invention is configured so that the smaller, second diameter 267 is supported by the generally M-shaped lower product support structure 250, as can be appreciated from FIG. 2. The second diameter 267 rests between sub-sections 231 and 221. The generally V-shaped relationship of those two sub-sections provide lateral support for the compressor.

The first and larger diameter 260 of R4 compressor 265 advantageously fits securely in the space between lower product support structure 250 and the back wall of the container formed by sub-section 81. Space 275, which lays between product support structure 250 and the back wall of the container, which is sub-section 81, is designed to be minimized, so that support structure 250 engages step-down 269 of R4 compressor 265. This design advantageously holds the compressor in place, on its side, to minimize front-to-back movement and potential damage to the compressor. Likewise, top product support 152 is designed to engage step-down area 269 of compressor 265 for additional support to secure the compressor within the invention. It can be appreciated that cut-out 150 has now formed into a notch as a result of the folding of sub-section 141 over sub-section 121. This notch can accommodate accessories and attachments that might protrude from compressor 265, as well as advantageously providing a finger hold for rotating top of support structure 152 away from and into the interior of the container to simplify the unpacking or packing of the container.

Figure 12:
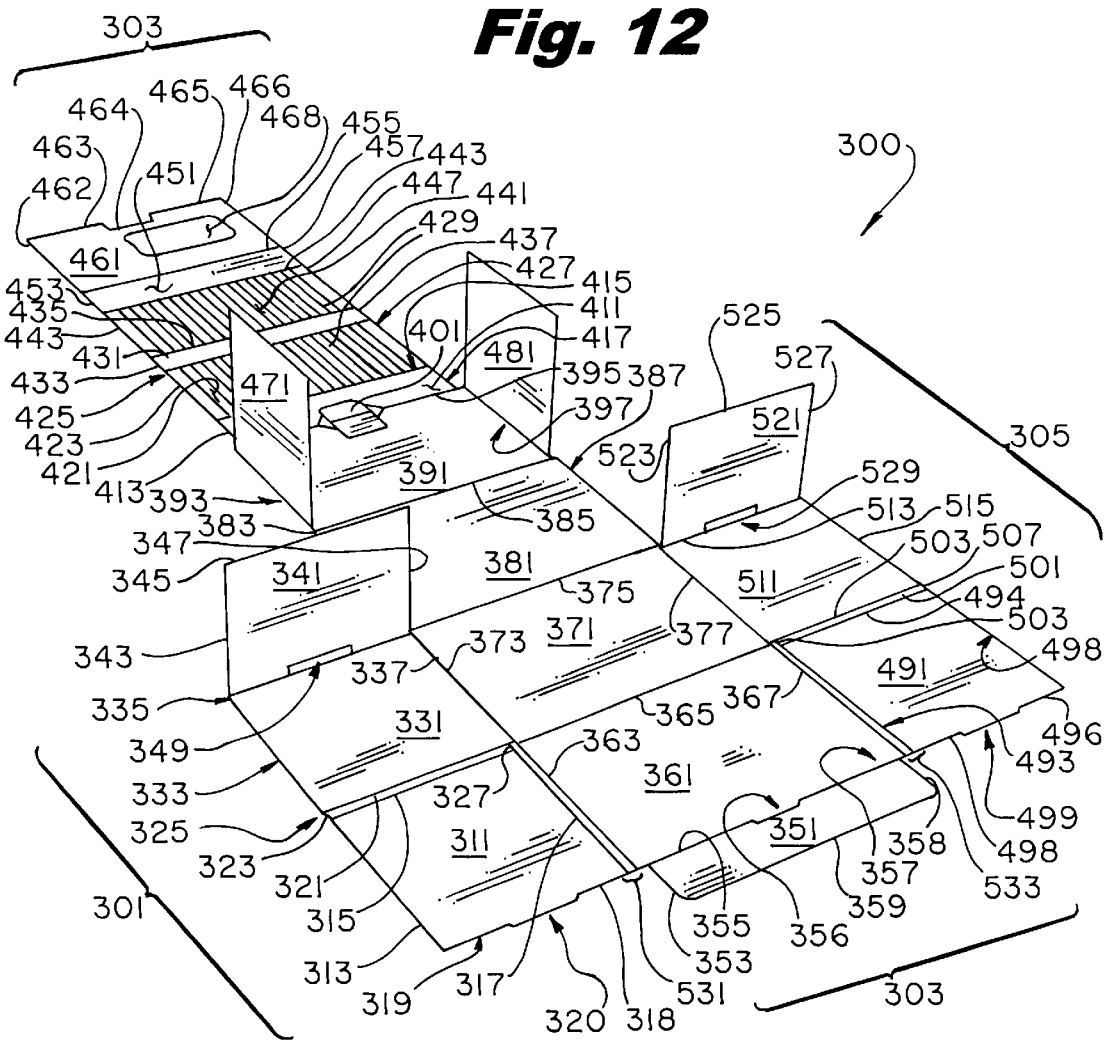
FIG. 12 is a perspective view of the container depicted in FIG. 11, partially assembled.
Figure 13:
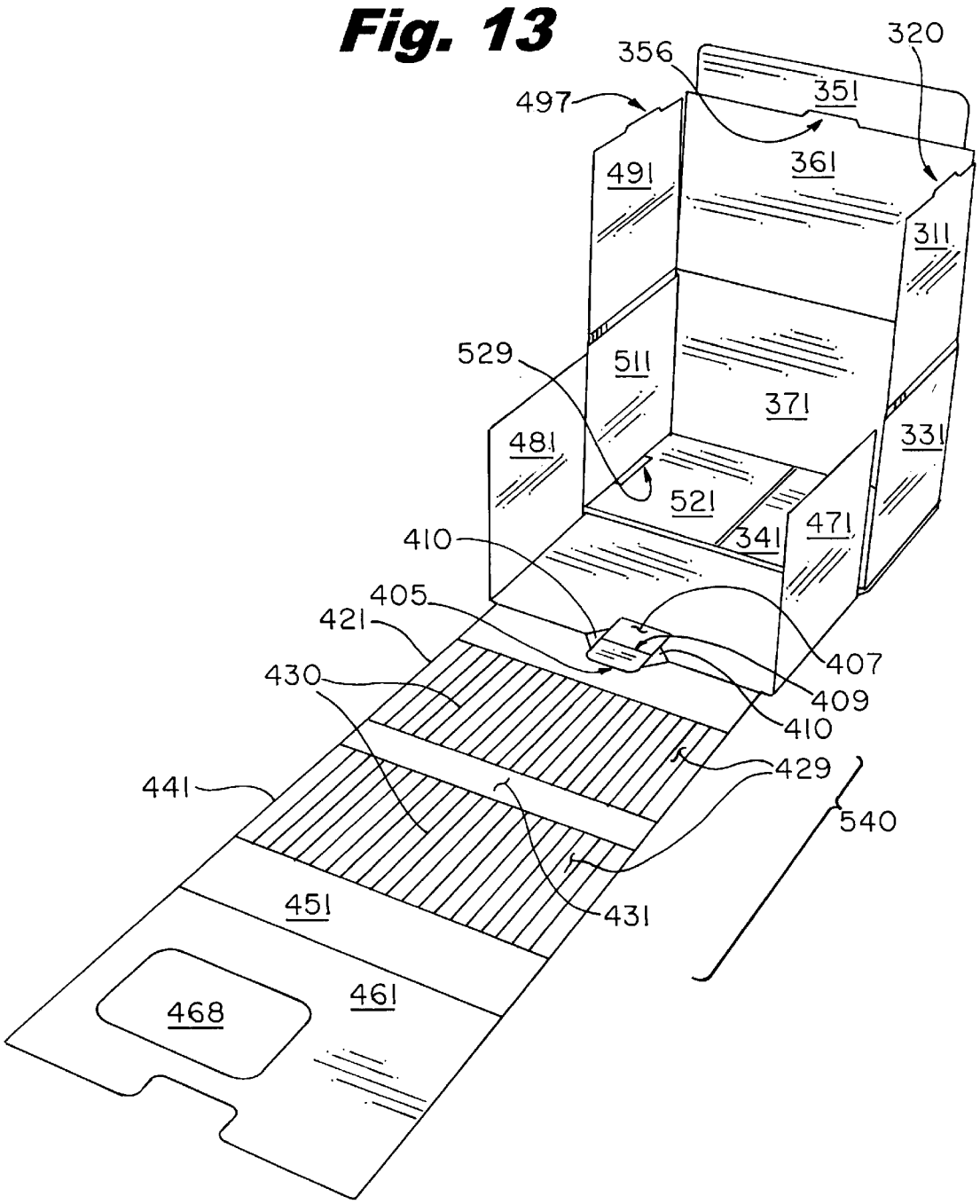
FIG. 13 is similar to FIG. 12, but with the box in a further stage of assembly.

A second embodiment of the invention is depicted in FIGS. 12 through 17. In this embodiment, the general structure of the unfolded blank can also be divided into three general sections. Section 301 is the left-hand section as depicted in FIG. 12, and is made up generally of four sub-sections, sub-section 311, 321, 331, and 341. Center section 303 is comprised of sub-sections 351, 361, 371, 381, 391, 401, 411, 421, 431, 441, 451, 461, 471, and 481. The third right-hand section is section 305 which consists of sub-sections 491, 401, 511, 521.

Sub-section 311 includes edge 319, edge 313, score line 315, edge 317, edge 318, tab 320, and edge 319. Sub-section 311 joins sub-section 321 at score line 315. Sub-section 321 includes a score line 315, edge 323, score line 325 and edge 327. Sub-section 321 lies between sub-section 311 and 331. Sub-section 331 includes edge 333, score line 335, score line 337, and score line 325.

Sub-section 341 is joined to sub-section 331 at score line 335. Sub-section 341 includes score line 335, edge 343, edge 345, and edge 347. Tab lock 349 includes sub-section 341 and is located along score line 335, and is configured to accept tab 320. Tab 351 depends from sub-section 361. Tab 351 includes edge 353, score line 355, tab 356, score line 357, edge 358, and edge 359. Sub-section 361 includes edge 363, score line 365, edge 367, and score line 357, tab 356, and score line 355. Sub-section 361 joins sub-section 371 at score line 365. Section 371 is further defined by score line 373, score line 375, and score line 377. Sub-section 371 joins sub-section 378 at score line 375. Sub-section 381 includes edge 383, score line 385, and edge 387 as well as score line 375.

Sub-section 391 includes score line 393, score line 397, score line 403, score line 395, score line 397, score line 385. Sub-section 401 joins sub-section 391 at score line 403. Section 401 is a locking tongue consisting of two sub-sections, sub-section 405 and sub-section 407, divided by score line 409. Section 411 includes edge 413, score line 415, edge 417, and score lines 395 and 397. Section 421 joins section 411 at score line 415. Sub-section 421 is further defined by edge 423, score line 425, edge 427, and score line 415.

Figure 14:
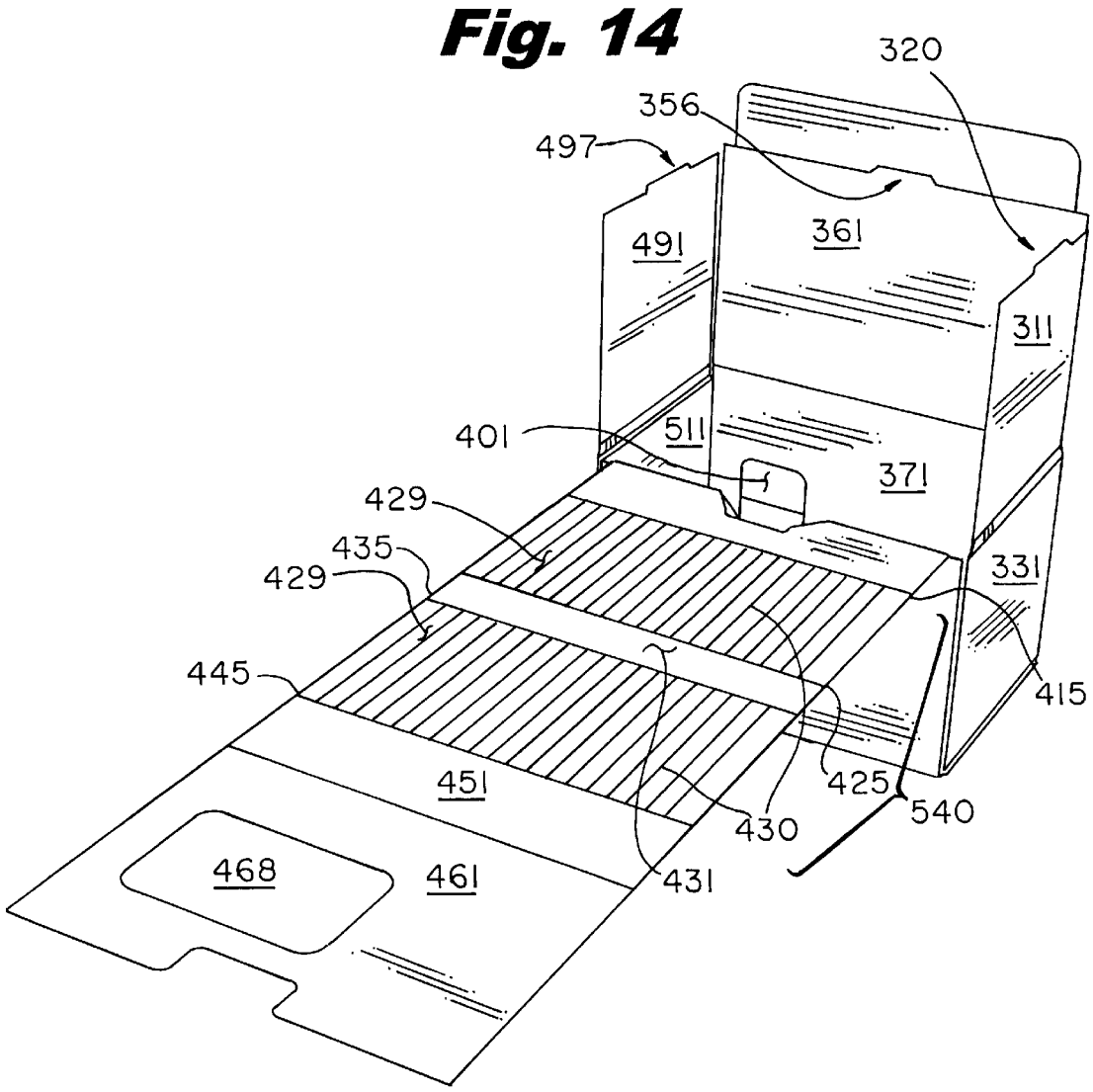
FIG. 14 is similar to FIG. 13, but with the box in a yet further stage of assembly, with the bottom surface partially formed.
Figure 15:
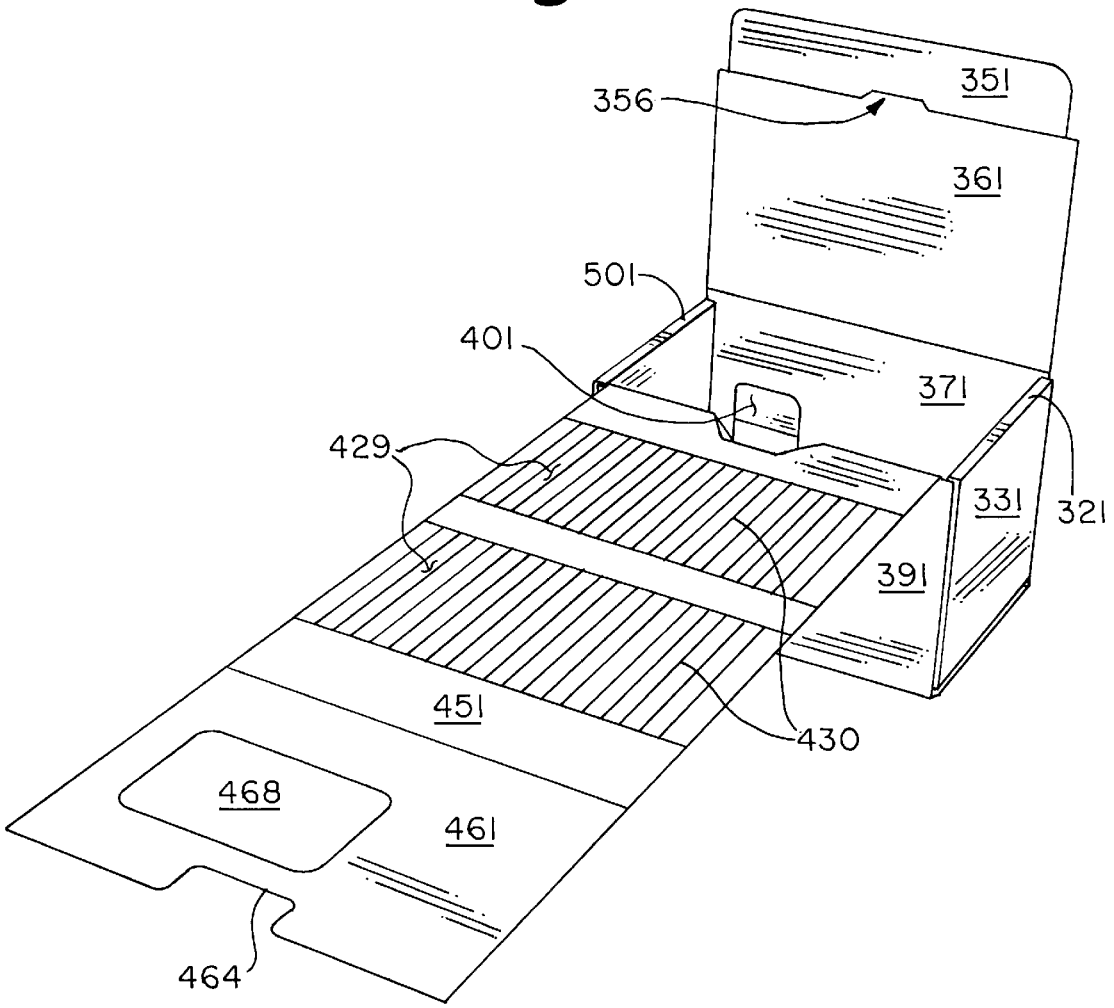
FIG. 15 is similar to FIG. 14, but with side wall flaps in place.
Figure 16:
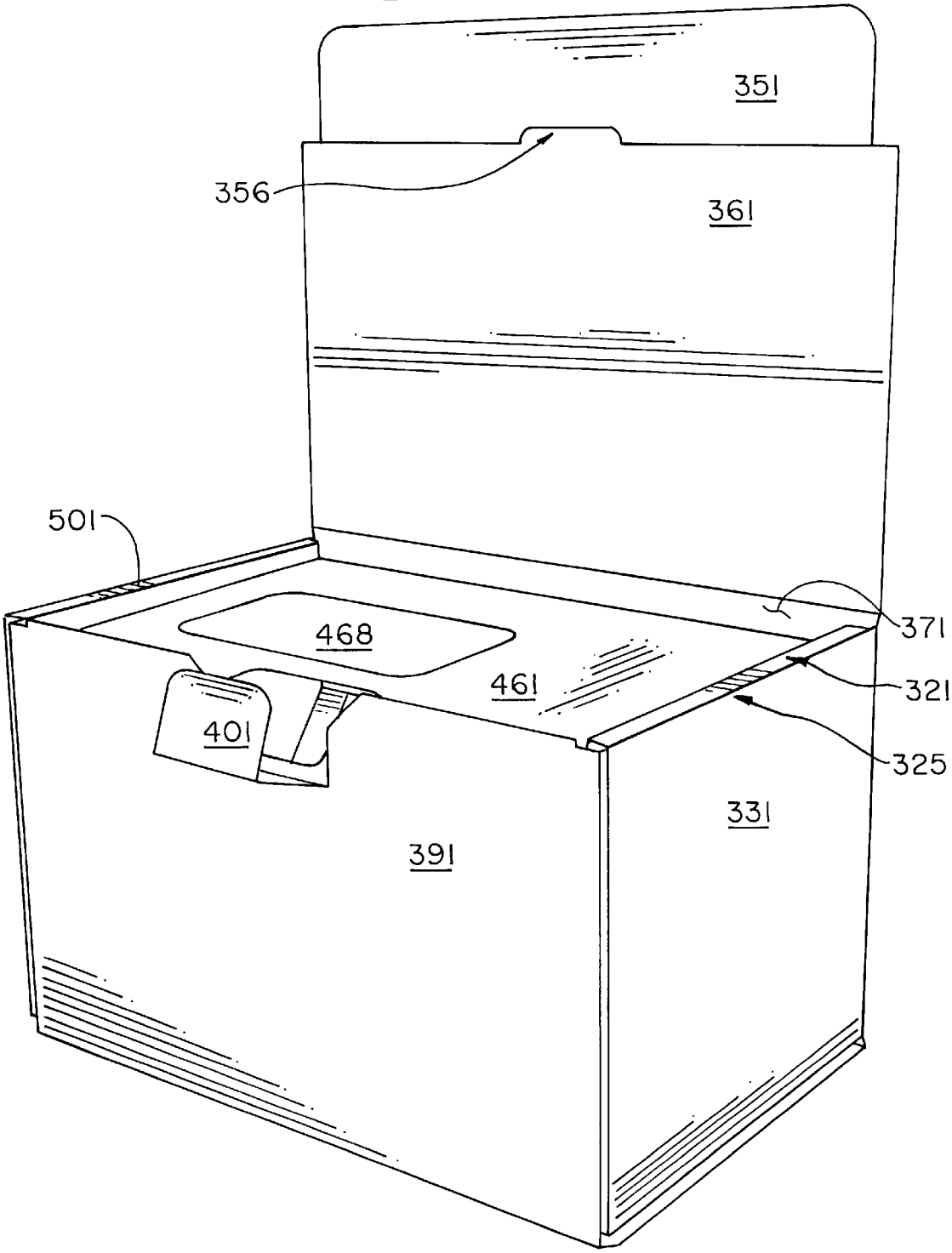
FIG. 16 is similar to FIG. 15, but with the internal product support structure in place.
Figure 17:
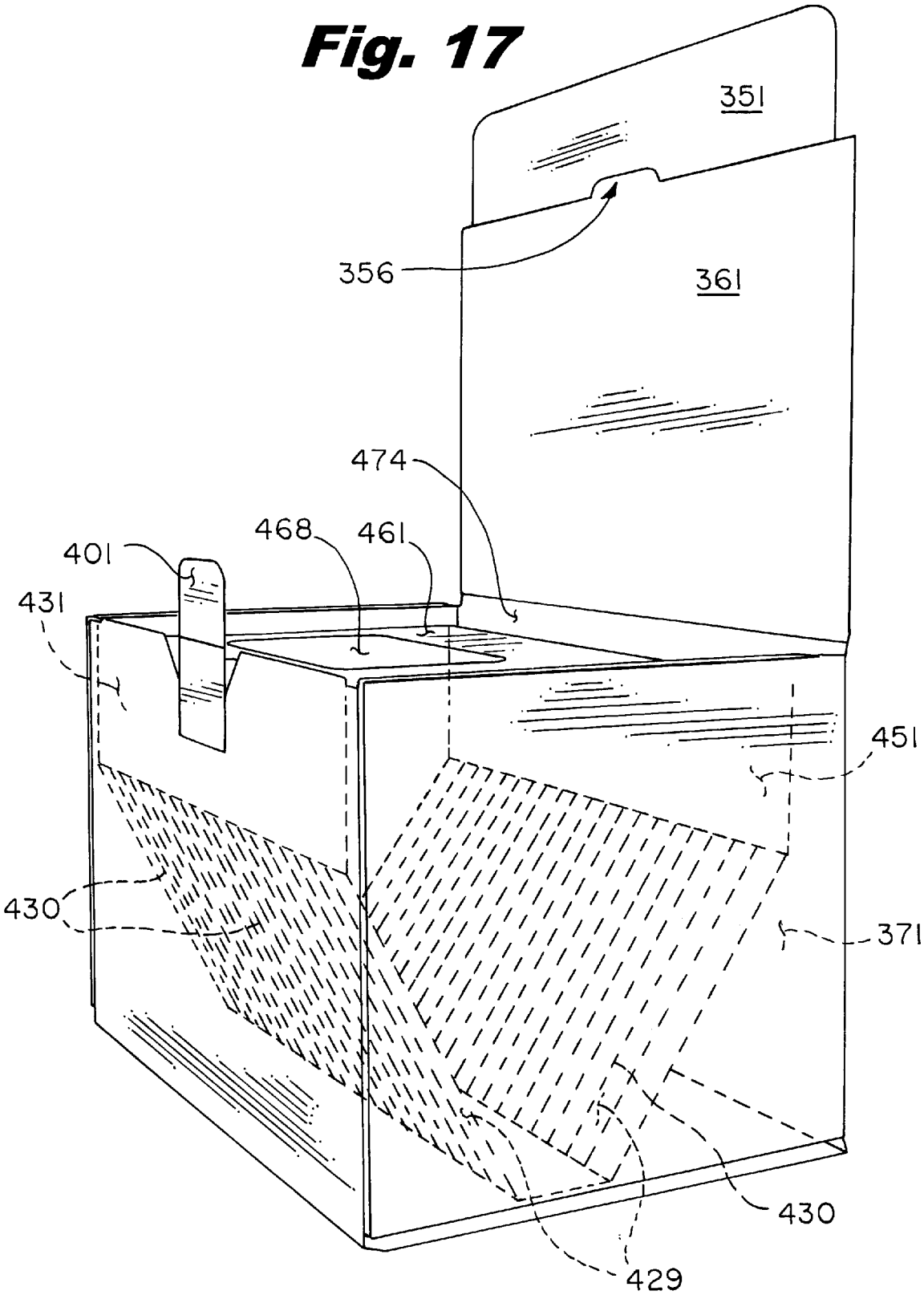
FIG. 17 is similar to FIG. 11, but without the phantom lines depicting the compressor.

Sub-section 441 contains a plurality of parallel slit cardboard sections 429 defined by slits 430. Section 441 contains similar slit cardboard sections 429. Product support 540 comprises sub-sections 421, 431 and 441, and comprises substantially planar wall members when in place in the interior of the box. Sub-section 431 lies between sub-section 421 and 441 and includes score line 425, edge 433, edge 435, and edge 437. V-shaped lower support 540 generally includes sub-sections 421, 431, and 441. Sub-section 441 includes edge 443, score line 445, edge 447 and score line 435. With particular reference to FIG. 14, score lines 415, 425, 435, 445 can be comprised of a series of slits or perforations. As previously mentioned, sub-section 441 contains a plurality of parallel slits sub-section 429. Sub-section 451 lies between sub-section 441 and 461 and includes edge 453, score line 455, edge 457, and score line 445. Sub-section 461 includes edge 462, edge 463, recessed edge 464, edge 465, edge 466 and score line 455. Oval scored portion 468 is fully incorporated in sub-section 461.

Sub-section 471 joins sub-section 391 at score line 393. Sub-section 471 is further defined by edge 473, 475 and edge 477. Sub-section 481 is joined to sub-section 391 at score line 397. Sub-section 481 is further defined by edge 483, edge 485 and edge 487. As stated above, sub-section 305 consists of sub-sections 491, 501, 511, and 521. Sub-section 491 includes edge 493, score line 494, edge 495, edge 496, tab 497, and edge 498. Sub-section 491 adjoins sub-section 501 at score line 494. Sub-section 501 further includes edge 503, score line 505, edge 507 and score line 494. Sub-section 501 lies between sub-section 491 and sub-section 511. Sub-section 511 is described by score line 377, score line 513, edge 515, and score line 505. Sub-section 511 joins sub-section 521 at score line 513. Sub-section 521 further includes edge 523, edge 525, edge 527. Slot 529 includes score line 513 and sub-section 521 and is configured to accept tab 497. Tab 531 is found between sub-sections 311 and 361 as further generally defined by edges 317 and 363. Tab 533 is found between sub-section 361 and 491 as generally defined by edges 367 and 493.

The assembly of the second embodiment will be described with reference to FIGS. 11 through 17, with blank 300, as generally appearing in FIG. 12, lying flat on a generally horizontal surface. Sub-section 341 is folded along score line 335 such that sub-section 341 is generally perpendicular to sub-section 331. Likewise, sub-section 521 is folded along score line 513 such that sub-section 521 is generally perpendicular to section 511. Sub-section 471 is folded along score line 393 such that sub-section 471 is generally perpendicular to sub-section 391. Likewise, sub-section 491 is folded generally along score line 397 such that sub-section 481 is substantially perpendicular to sub-section 391. This stage of the assembly of blank 300 is shown in FIG. 12.

Next section 301 is folded along score line 373 such that sub-section 331 is generally perpendicular to section 371 and sub-section 311 is generally perpendicular to sub-section 361. Likewise, section 301 is folded along score line 377 so that sub-section 511 is generally perpendicular to sub-section 371 and sub-section 361 is generally perpendicular to sub-section 491. In this configuration, edge 345 forms with edge 525. Section 301 and 305 and sub-sections 351, 361 and 371 of section 303 are folded along score line 375 such that sub-sections 341 and 521 overlay sub-section 381 forming a base of the container. This stage of the assembly can be seen generally in FIG. 13.

Sub-section 349 is folded along score line 385 such that sub-sections 371 and 381 slide interior of sub-sections 331 and 511, respectively. Sections distal of sub-section 391 remain outside the interior of the container, by folding along score lines 395 and 397. This can be seen in FIG. 14.

Sub-section 311 is folded along score lines 323 and 325 and tab 320 is engaged in tab slot 349. Likewise, sub-section 491 is folded along score lines 494 and 505 such that tab 497 engages slot 529. This stage of the assembly is generally shown in FIG. 14.

Sub-sections 421, 431, and 441, are folded so that sub-sections 421 and 441 form a generally V-shape in the interior of the container and sub-section 431 is lying flat on the bottom of the container formed by sub-sections 341 and 521. Sub-section 561 is then folded around score line 453 such that sub-section 461 is generally parallel to the bottom of the container formed by sub-sections 341 and 521 overlaying sub-section 381. In this configuration, sub-sections 411 and 451 lay against the front and rear walls, defined by sub-section 391 and 371 respectively. This stage of the assembly can be viewed in FIG. 16.

The lid of the container, sub-section 61, can be closed and secured by folding sub-section 61 along score line 365 until sub-section 361 is parallel to the bottom of the container, defined by sub-section 381 and sub-sections 341 and 521. Flap 551 is then folded along score lines 555 and 357 such that it frictionally engages between edges 463 and 465 and sub-section 411. Then locking tongue 411 can be folded at score line 409 and inserted in the slot formed by the folding of flap 551, under tab 356.

Figure 10:
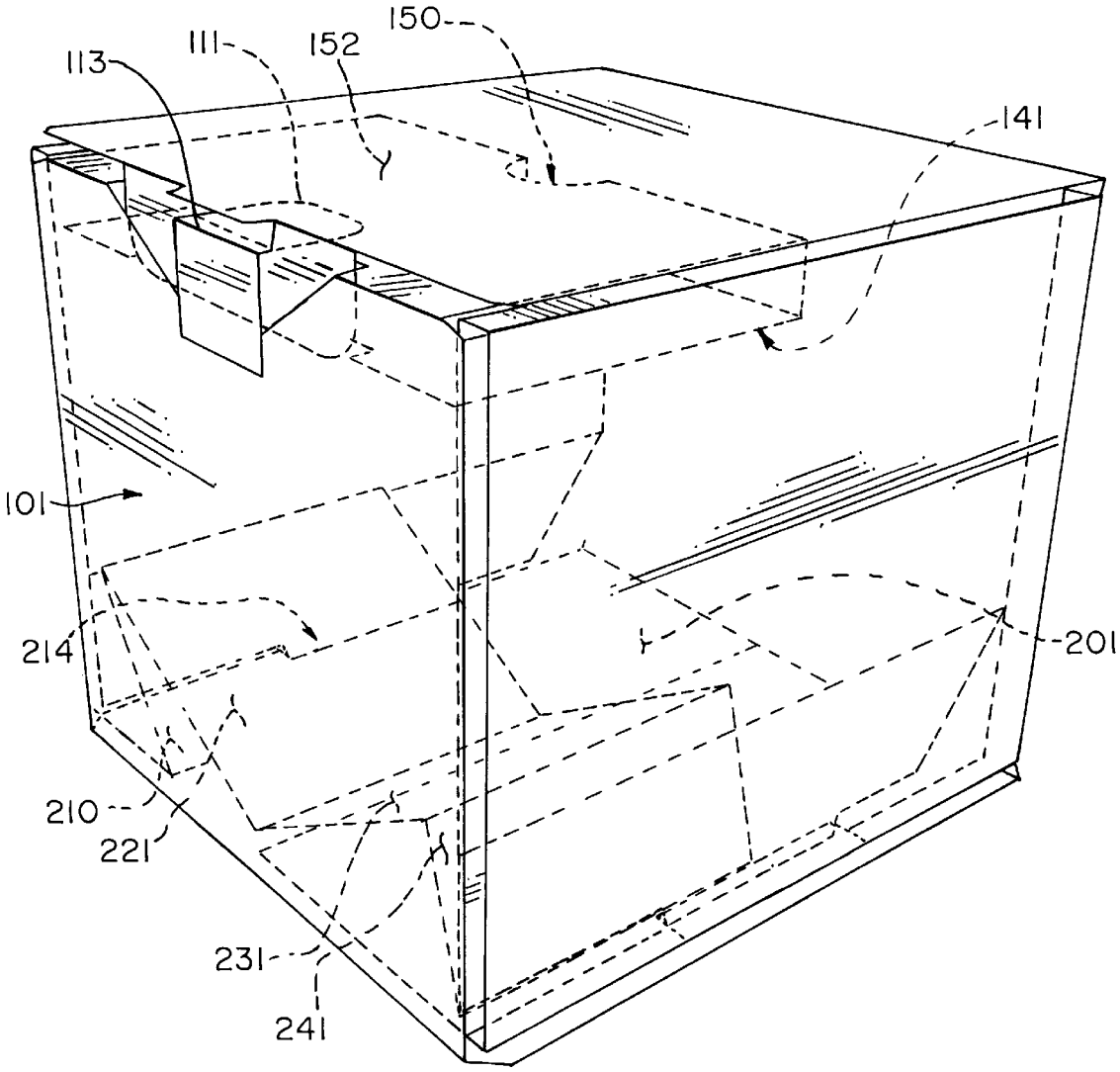
FIG. 10 similar to FIG. 2, but without the phantom lines depicting the compressor.
Figure 11:
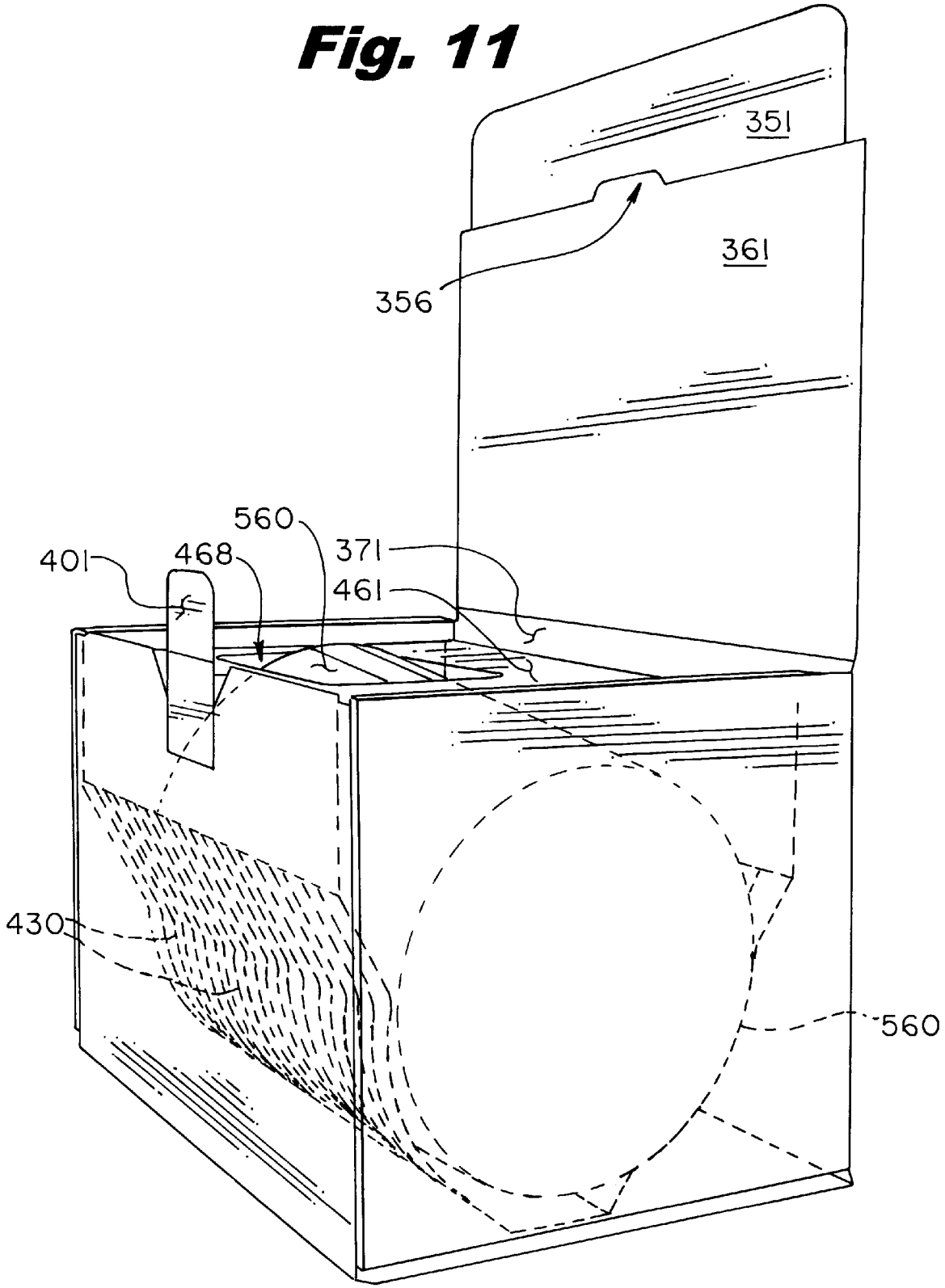
FIG. 11 is a perspective view of a second embodiment of a container for compressors and other goods in accordance with the invention, with phantom lines depicting internal supports and product carried within the box.

To store a product or good within the invention, the lid of the container, sub-section 361, and the secondary lid, sub-section 461, are rotated away to expose the interior of the container. Compressor 560 (or other cylindrical object) is then placed in the container as shown in FIG. 10. Parallel flexing strips 429, deform, flex and tear away to conform to the shape of compressor 560, advantageously securing the compressor within the container. Secondary lid, sub-section 461, can then be closed by folding along score line 455 until the secondary lid substantially engages the product and/or the top edges of the container. Perforated oval section 468 can be removed to accommodate different configurations of compressors, or accessories attached thereto. Deformable strips 429 are defined by slits so that each strip is generally free to move independently of the strip adjacent to it. This allows for the strips to conform individually to various surface features of products stored within the container. The strips can be configured to tear away by perforating the top and bottom edges thereof. It is anticipated that the strips can be cut to be wider, thinner, or a combination of wide and thin, than those depicted in the drawing, depending upon the type of product intended to be stored therein. The strips may be substantially rectangular. The lid then can be secured as previously described above.

It should be noted that the construction of the sidewalls, as in the first embodiment of the subject invention, consists of three layers of material, that is sub-sections 311 and sub-section 331 enclosing sub-section 471, and sub-sections 491 and 511 enclosing sub-section 481.

What is claimed is:

1. A box for accommodating an object, the box comprising:

a base;

a plurality of upstanding sidewalls extending from the base, the base and the upstanding sidewalls defining an interior of the box; and a product support disposed within the interior of the box, the product support comprising a continuous sheet extending generally between said sidewalls, the continuous sheet including at least two substantially planar wall members extending generally upwardly relative to the base of the box, the wall members each defining a plurality of substantially parallel tear-away slits, the tear-away slits defining side edges of a plurality of substantially parallel flexing strips extending across said wall members, the flexing strips having opposed ends;

wherein multiple flexing strips of each wall member are constructed to flex outwardly and tear away along the side edges to accommodate and support the object within the box and to generally conform to the shape of the object within the box, further wherein additional flexing strips of each wall member can remain generally intact, at least at both of the respective opposed ends thereof, to generally preclude longitudinal movement of the object within the box.

2. The box of claim 1, wherein the continuous sheet comprises a single sheet depending from at least one of the sidewalls of the box.

3. The box of claim 1, wherein the product support comprises a substantially planar base member extending between the wall members, the base member of the product support being generally parallel to the base of the box.

4. The box of claim 1, wherein each flexing strip comprises a top edge and a bottom edge, said top edge and bottom edge being defined by partial tear-away slits.

5. The box of claim 1, wherein each wall member comprises a fold line extending substantially across the entire wall member, the fold line defining a top edge of each flexing strip.

6. The box of claim 5, wherein each wall member includes a plurality of perforations extending along the fold line.

7. The box of claim 1, wherein the flexing strips are immediately adjacent each other.

8. The box of claim 1, wherein the flexing strips are each substantially rectangular.

9. The box of claim 1, wherein the flexing strips are each substantially identically dimensioned.

* * * * *